United States Patent [19]

Bremer

[11] Patent Number: 4,666,092

[45] Date of Patent: May 19, 1987

[54] TORQUE LIMITER FOR GYRATORY CRUSHER ANTI-SPIN CLUTCH

[75] Inventor: James C. Bremer, Milwaukee, Wis.

[73] Assignee: Barber-Greene Company-Telsmith Division, Milwaukee, Wis.

[21] Appl. No.: 813,494

[22] Filed: Dec. 26, 1985

[51] Int. Cl.[4] ..... B02C 2/04

[52] U.S. Cl. ..... 241/214

[58] Field of Search ..... 241/207, 216, 286, 290

[56] References Cited

U.S. PATENT DOCUMENTS 3,887,143 6/1975 Gilbert et al. ..... 241/215

*Primary Examiner*—Timothy V. Eley

*Attorney, Agent, or Firm*—James E. Nilles; James R. Custin

[57] ABSTRACT

The automatic random reset torque limiter of the invention, connected between the crushing head of a gyratory crusher and its one-way anti-spin clutch, comprises a carrier element and a coaxial detent element that have end surfaces opposing one another across a small gap. The carrier has wells opening to its end surface that are equidistant from its axis and are uniformly spaced from one another. The detent element has hemispherical cavities in its end surface, one for each well, each alignable with a well. In each well is a coiled compression spring and a ball. The spring normally holds the ball engaged in a cavity but allows it to ride out of the cavity and roll on the detent element end surface while excessive torque persists.

5 Claims, 4 Drawing Figures

TORQUE LIMITER FOR GYRATORY CRUSHER ANTI-SPIN CLUTCH

FIELD OF THE INVENTION

This invention relates to gyratory crushers of the type wherein a conical crushing head, carried for gyration by an upright eccentric that rotates in one direction, cooperates with a stationary bowl or concave that overlies the crushing head, and wherein a one-way clutch connected between the frame of the crusher and the crushing head prevents the latter from rotating relative to the frame in said one direction but permits its rotation in the opposite direction; and the invention is more particularly concerned with improvements in such a crusher whereby damage to the one-way clutch is prevented when the crushing head is subjected to an abnormally high torque in the direction of rotation of the eccentric.

BACKGROUND OF THE INVENTION

When a gyratory crusher is in crushing operation, the crushing head, through the material being crushed, has rolling engagement with the concave and thus rotates, relative to the crusher frame and the eccentric, in the direction opposite to that of eccentric rotation. To accommodate such relative rotation of the crushing head it is freely rotatably mounted on the eccentric. However, in the absence of an anti-spin feature the crushing head tends to rotate in the same direction as the eccentric when the crusher is operating without a load. When material to be crushed is then fed between the freely spinning crushing head and the concave, the material retards the rotation of the head and in doing so detrimentally abrades the crushing elements and especially the concave.

U.S. Pat. No. 3,744,728, issued in 1973, disclosed a gyratory crusher wherein free spinning of the conical crushing head in the direction of rotation of the eccentric was prevented by means of a hydraulic motor connected between the crushing head and the eccentric. Under no-load conditions that motor drove the crushing head for rotation relative to the eccentric in the direction opposite to that of eccentric rotation and at a rotational speed equal to that of the eccentric. During crushing, friction between the concave and the crushing head imposed upon the crushing head a torque which supplemented that of the hydraulic motor, allowing the crushing head to rotate as necessary for its rolling engagement with the concave. This anti-spin mechanism was relatively expensive because of the cost of the hydraulic motor, which was of the gerotor type; and it was not consistently reliable in operation, owing to the difficulty of so controlling the feed of pressure oil to the hydraulic motor as to assure its being driven at exactly the rotational speed of the eccentric shaft.

A more recent anti-spin mechanism for gyratory crushers has comprised a one-way clutch connected between the crusher frame and the crushing head and arranged to confine the crushing head against rotation relative to the frame in the direction of eccentric rotation but to permit its substantially free rotation in the opposite direction. This arrangement had the advantage of being lower in cost than the hydraulic pump anti-spin mechanism, and it was satisfactorily operative under normal conditions.

However, it sometimes happens during a crushing operation that the crushing head is virtually locked to the eccentric and is compelled to rotate with it. This can occur when the crusher is somewhat overloaded and crushed material becomes jammed between the eccentric and the crushing head, or when very cold weather congeals the oil that lubricates the crushing head bearings. At such times the high torque transmitted to the crushing head from the eccentric shaft is imposed upon the one-way clutch, which cannot reasonably be designed to resist rotational forces of such magnitude.

To protect the one-way clutch from excessive torque in its rotation inhibiting direction, the connection between it and the crushing head has heretofore comprised a shear pin that was designed to break at a torque value safely below the maximum that the one-way clutch could support. With some materials put through the crusher, breaking of the shear pin was an almost daily occurrence. Each such breakage required shutdown of the crusher and replacement of the broken pin. Since the crusher was out of service for at least half an hour during this operation, the shearing of a pin was very expensive in terms of lost production.

It is perhaps obvious that a torque limiting shear pin can be replaced by a clutch-like torque limiting device under some circumstances. But torque limiters heretofore available have not been suitable for gyratory crushers. The great majority of torque limiters release at torque values well below those normal in gyratory crusher operation and therefore cannot be used in an anti-spin mechanism. Many torque limiters, once released, must be reset either by effecting reverse relative rotation of the parts connected by the device or by performing a resetting operation on the device with the use of a special tool; and in either case resetting of such a torque limiter, if it were installed in a crusher, would necessitate shut-down of the crusher for some period of time.

Owing to the eccentric arrangement of a seal which normally surrounds the crushing head and protects the bearings that rotatably support it on the eccentric shaft, a jam that tends to lock the crushing head to the eccentric shaft usually clears itself in one revolution of that shaft. For this reason the most desirable type of torque limiter for the purpose here under consideration is a so-called automatic random reset device, which simply resets itself to its torque transmitting condition as soon as a torque overload is relieved, irrespective of the then-existing relative positions of rotation of the parts connected by the device. Although some automatic random reset torque limiters have heretofore been available, they have not been suitable for gyratory crusher anti-spin applications. Among other objections is the fact that known devices of this type have not been so configured that they could be installed as direct replacements for the heretofore conventional shear pin assembly, so that adapting the crusher for such a device would have necessitated a substantial and expensive redesign of the crushing head and possibly also of the eccentric shaft.

SUMMARY OF THE INVENTION

One general object of the present invention is to provide a simple, inexpensive and compact torque limiter which is bidirectional, which is capable of transmitting torque of up to a high predetermined value and of releasing under a torque in excess of that value, and which, after release, automatically resets itself as soon as the applied torque drops below that value, irrespective of the positions of relative rotation of the parts connected by the device.

Another object of the invention is to provide a torque limiter of the character described which is suitable for installation in a gyratory crusher having an anti-spin mechanism comprising a one-way clutch, to protect the one-way clutch from excessive torque in the direction of eccentric rotation and as a direct replacement for the shear pin assembly heretofore installed for protection of the one-way clutch.

From the above stated objects of the invention it will be apparent that it is another and very important object of the invention to provide a gyratory crusher anti-spin mechanism of the type comprising a one-way clutch, wherein the one-way clutch is protected from torque overloads by a torque limiter of such character that the crusher need not be shut down, even momentarily, upon the occurrence of a torque overload.

Thus the ultimate object of the present invention is to increase the overall productivity of a gyratory crusher having an anti-spin mechanism, and to do so, moreover, at a cost that is negligible in relation to the value of the gain in productivity.

A more specific object of the invention is to provide a simple, compact and inexpensive torque limiter that is adapted for installation in a cavity in the crushing head of a gyratory crusher, directly above a one-way anti-spin clutch which is also installed in that cavity, said torque limiter providing a connection between the crushing head and the one-way clutch that is normally locked for transmission of torque between the crushing head and the one-way clutch but is released when the crushing head is subjected to a torque in excess of a predetermined value which tends to rotate it in the direction that the one-way clutch normally restrains it from turning.

In connection with the last stated object, it is a further specific object of the invention to provide a torque limiter of the character described which can be installed as a direct replacement for a heretofore conventional shear pin assembly, which is maintained assembled by its securement in the cavity in the crushing head, and which has simple means whereby it is held preassembled prior to and during its installation in the crushing head.

BRIEF DESCRIPTION OF THE DRAWINGS

In the accompanying drawings, which illustrate what is now regarded as a preferred embodiment of the invention.

DETAILED DESCRIPTION OF A PREFERRED EMBODIMENT OF THE INVENTION

Figure 1:
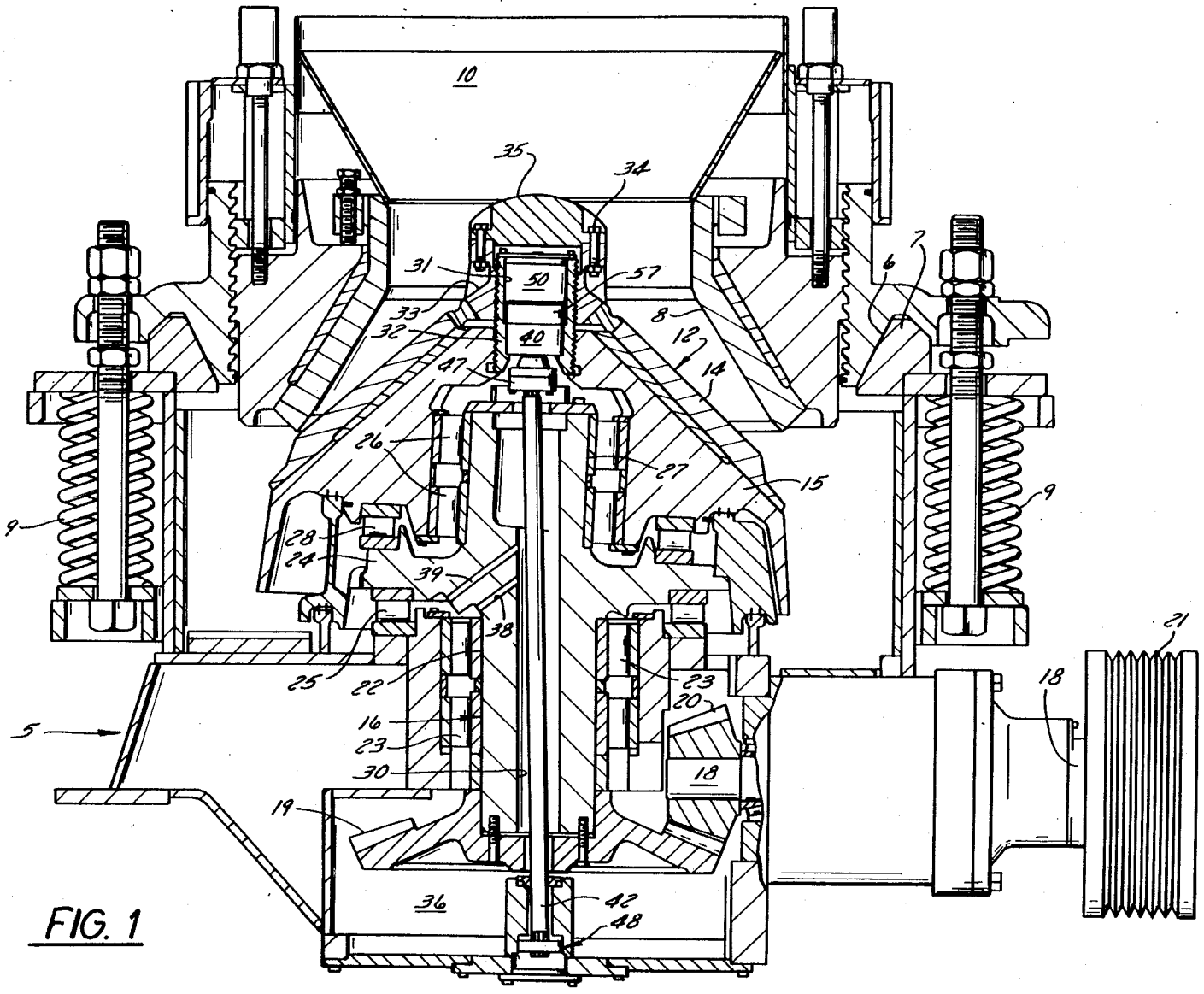
FIG. 1 is a view in vertical section through a gyratory crusher that embodies the principles of this invention.
Figures 2, 3, 4:
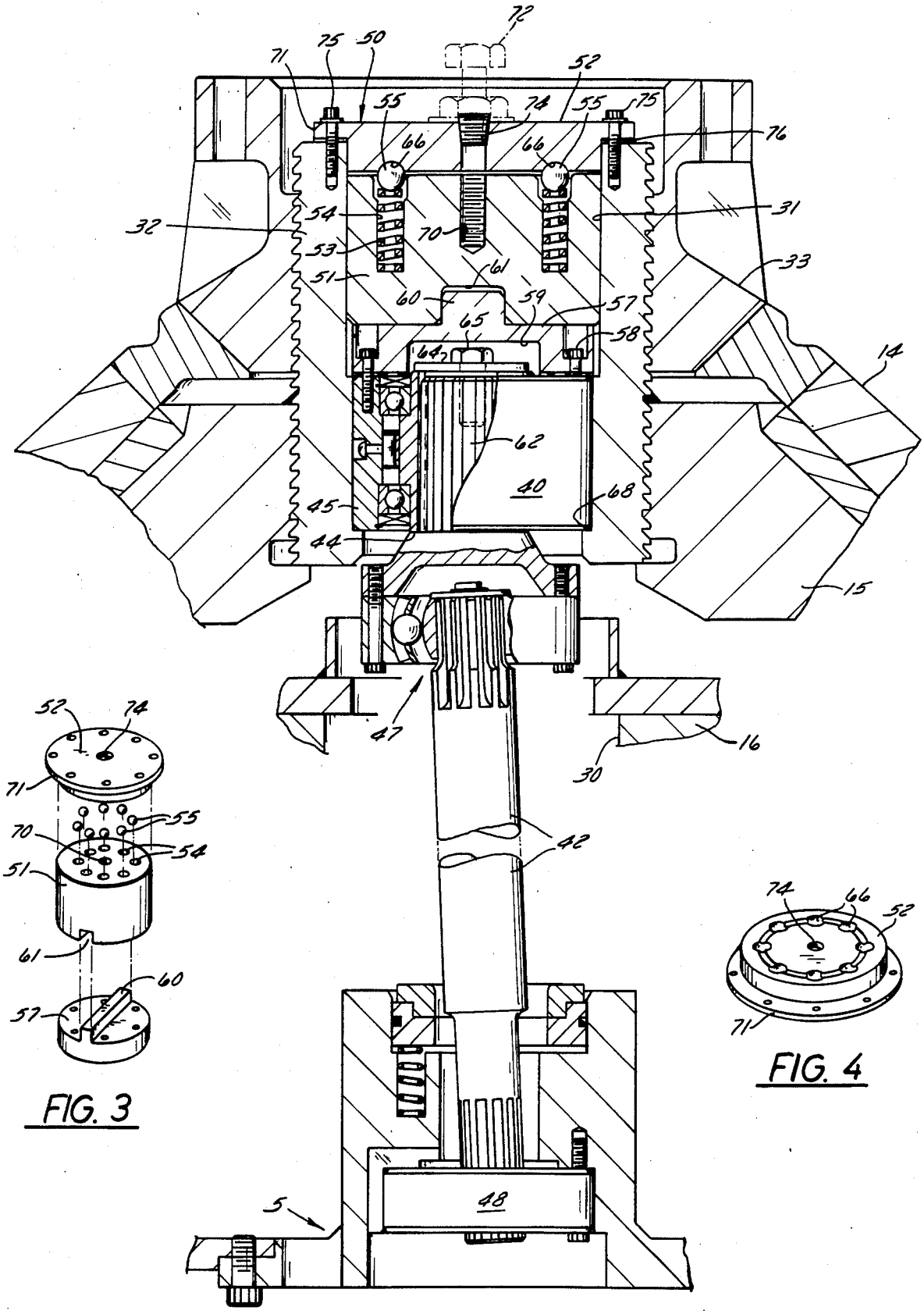
FIG. 2 is an enlarged view in vertical section of the portion of the crusher that comprises the anti-spin mechanism and the torque limiter that protects it.
FIG. 3 is a disassembled perspective view of the torque limiter.
FIG. 4 is a bottom perspective view of the detent element of the torque limiter.

A gyratory crusher that embodies the present invention comprises a rigid main frame 5 that has near its top a downwardly convergent frustoconical surface 6 upon which a concave supporting ring 7 is normally seated. Secured to the ring 7 is a downwardly divergent frustoconical liner 8 of manganese that comprises the concave proper and serves as the relatively stationary crushing element of the crusher. As is conventional, the concave supporting ring 7 is held down against its seat 6 by means of strong springs 9 that permit the concave to rise slightly in response to excessive crushing loads such as are due to the presence of so-called tramp iron or other uncrushable material. At the top of the concave and concentric with it is a hopper 10 through which material to be crushed—ore or the like—is fed into the crusher.

The movable crushing element that cooperates with the concave is a substantially conical crushing head 12. Its downwardly divergent crushing surface, which opposes the crushing surface defined by the concave liner 8, is likewise defined by a hard liner 14 of manganese that is rigidly secured to its body portion 15. The crushing head is carried on, and driven by, an upright eccentric shaft 16 that is supported for rotation by the crusher frame 5. A horizontally extending drive shaft 18, rotatably journalled in the frame 5, drives the eccentric shaft 16 for rotation through a bevel gear 19 that is fixed on the bottom of the eccentric and a meshing bevel gear 20 fixed on an inner end of the drive shaft. The drive shaft 18 is rotatably driven from a conventional power source (not shown) through a multiple V-belt pulley 21 on its outer end.

The eccentric shaft 16 has a lower portion 22 that is journalled in the frame 5 in radial roller bearings 23 and has a medial portion 24 of substantially larger diameter which is supported on thrust roller bearings 25 that ride on an annular surface on the frame. The crushing head 12 is journalled on radial roller bearings 26 which surround an upper portion 27 of the shaft 16 that is eccentric to its lower portion 22. The weight of the crushing head is borne by thrust roller bearings 28 that ride on the radially projecting medial portion 24 of the shaft 16.

At this point attention is directed to the fact that the eccentric shaft 16 is hollow, having a bore 30 extending through its entire length; and there is likewise a bore 31 through the crushing head 12 that opens downward to the upper end of the bore 30 in the eccentric shaft. Preferably the bore 31 in the crushing head is defined by the inner surface of a substantially tubular adapter screw 32, the lower portion of which is threaded into and welded to the body 15 of the crushing head. Onto the upper portion of the tubular adapter screw 32 is threaded an annular cap 33 that secures the liner 14 to the body of the crushing head. Removably secured to the cap 33, as by bolts 34, is a cover 35 that closes the upper end of the bore 31 in the crushing head so that said bore 31 comprises, in effect, a downwardly opening cavity in the crushing head.

The bore 30 in the eccentric shaft, which is radially enlarged in the eccentric upper portion of that shaft, opens downward to an oil reservoir 36 at the bottom of the frame from which oil is pumped up through that bore. For lubrication of the eccentric shaft bearings 23 and 25, oil passages 38, 39 in the eccentric shaft open radially from its bore 30. Oil passing out of the upper end of that bore and radially across the top of the eccentric shaft flows down into the crushing head bearings 26 and 28.

It will be apparent that the crushing head 12 is moved in an orbit by rotation of the eccentric shaft 16, and that during crushing the crushing head has rolling engagement with the concave 8, through the material being crushed, whereby the crushing head is caused to rotate, relative to the frame and the eccentric shaft, in the direction opposite to that of eccentric shaft rotation. With no load in the crusher, the crushing head tends to rotate in the same direction as the eccentric shaft 16, and such free spinning of the crushing head is undesirable, as explained above. To prevent such spinning, but permit the crushing head to rotate for crushing cooperation with the concave, a one-way clutch 40 (also known as a free-wheeling clutch or overrunning clutch) is mounted in the bore 31 in the crushing head, and an upright anti-spin shaft 42 that is connected at its upper end with the one-way clutch extends downward through the bore 30 in the eccentric shaft and has its lower end connected with the frame 5 below the eccentric shaft. The one-way clutch 40 comprises coaxial radially inner and radially outer clutch elements 44, 45. These elements cooperate with a known mechanism that permits the radially outer clutch element 45 to rotate in a free-wheeling direction relative to the radially inner one 44 but prevents such relative rotation in an opposite locking direction. The anti-spin shaft 42 is connected with the inner element 44 of the one-way clutch by means of a known joint fitting 47 (so-called constant velocity joint) which prevents relative rotation between that clutch element and the anti-spin shaft but allows the latter to swing relative to the axis of the clutch element. The connection between the frame 5 and the lower end of the anti-spin shaft comprises a similar fitting 48. Thus the inner element 44 of the one-way clutch is at all times confined against rotation relative to the frame.

The outer element 45 of the one-way clutch must be normally locked to the crushing head 12, for free-wheeling rotation with it in the direction opposite to that of eccentric rotation and to restrain it against spinning in the direction that the eccentric turns. Heretofore the means for effecting such normal locking comprised a cup-shaped insert that was secured in the upper portion of the bore 31 in the crushing head and a shear pin that extended through the bottom wall of that insert and down into the outer element 45 of the one-way clutch. The cup-shaped insert had a radially outwardly projecting flange around its rim that overlay the upper end of the tubular adapter screw 32 in the crushing head, and bolts extended through that flange and down into the adapter screw to lock the insert to the crushing head. Thus replacement of a sheared pin required removal of the cover 35 from the crushing head, for access to the bolts that secured the cup-shaped insert, and removal of the insert for access to the broken shear pin.

According to the present invention, the one-way clutch 40 is protected by means of an automatically resetting torque limiter 50 which is installed in the location previously occupied by the cup-shaped insert of the shear pin assembly and is connected between the crushing head and the outer element 45 of the one-way clutch. So long as the torque to be transferred from the crushing head to the outer one-way clutch element 45 is below a predetermined value, the torque limiter 50 of this invention effectively locks the crushing head to that clutch element 45 and thus serves to prevent spinning of the crushing head in the direction of eccentric rotation; but when such torque exceeds that value, and for as long as that value is exceeded, the torque limiter releases to permit rotation of the crushing head relative to the clutch element 45. As soon as the torque falls back below the predetermined value, as upon clearing of a jam that has tended to lock the crushing head to the eccentric, the torque limiter 50 automatically resets itself and once again serves to transmit torque from the crushing head to the outer clutch element 45.

The torque limiter 50 of this invention comprises a substantially cylindrical lower carrier element 51 that is concentrically secured to the outer element 45 of the one-way clutch, an upper disc-like detent element 52 that is concentrically secured to the tubular adapter screw 32, a plurality of coiled compression springs 53 that are received in upwardly opening axially deep wells 54 in the carrier element 51, and a plurality of balls 55, one for each of the springs 53, each confined between its spring 53 and the detent element 52.

The carrier element 51 of the torque limiter is secured to the outer element 45 of the one-way clutch by means of an adapter 57 of circular planform that directly overlies the one-way clutch. The adapter 57 has a circle of bolt holes near its perimeter through which bolts 58 extend that are threaded downwardly into the outer element 45 of the one-way clutch, to fix the adapter to that clutch element. A diametrically extending rib 60 on the top of the adapter 57 projects upward into a closely fitting diametrical slot 61 in the bottom of the torque limiter carrier element 51, to provide a rotation transmitting connection between the adapter 57 and the carrier element 51.

At its underside the adapter 57 has a coaxial cavity 59 whereby it is spaced from the inner element 44 of the one-way clutch. Within that cavity is accommodated a washer 64 and the head of a bolt 65 that is threaded into a shaft 62 which extends through the inner element 44 of the one-way clutch. The bolt 65, washer 64 and shaft 62 cooperate to maintain a rigid connection between the inner clutch element 44 and the upper constant velocity joint 47.

The upwardly opening axially extending wells 54 in the torque limiter carrier element 51, in each of which a spring 53 is seated, are radially spaced at like distances from the axis of the carrier element and are circumferentially spaced apart at uniform distances. Each of the coil springs 53 is required to exert a large force when compressed, in order for the torque limiter to be adapted to transmit torques below a high predetermined value, and to this end each is preferably a die compression spring of rectangular-section wire.

The detent element 52 of the torque limiter has a radially outwardly projecting circumferential flange portion 71 which overlies the upper end surface of the tubular adapter screw 32 in the crushing head, so that the main portion of the detent element projects down into the adapter screw with a fairly close fit. A ring of bolt holes in the flange portion 71 receives bolts 75 that are threaded downward into the adapter screw to fix the detent element to it. At its underside the detent element 52 has a flat bearing surface which opposes and is spaced from the flat top surface of the carrier element 51 by a distance substantially smaller than the diameter of the balls 55. In the bottom of the detent element are a plurality of substantially hemispherical cavities 66, one for each of the spring wells 54 in the carrier element, spaced from the axis of the detent element and from one another in correspondence with the spacing of the wells 54 in the carrier element. Hence there are a number of positions of relative rotation of the coaxial torque limiter elements 51, 52—as many such positions as there are wells 54—at which each cavity 66 will be aligned with a well 54. It will be apparent that at each such position each of the balls 55 will be seated in a cavity 66 and normally maintained there by the force of its spring 53. Owing to the small distance between the opposing surfaces of the upper and lower torque limiter elements 51, 52, each ball will also always be received, at least in part, in its spring well 54 in the carrier element. When torque in excess of the above mentioned predetermined value tends to rotate one of the torque limiter elements 51, 52 relative to the other (in either direction) the balls 55 will be cammingly displaced out of the cavities 66 and down into their wells 54 against the bias of their springs 53, to roll on the bearing surface at the underside of the detent element 52 and thus permit relative rotation between the torque limiter elements. During such rotation the balls, maintained captive in the spring wells 54, are constrained to move in an orbit in which they have detent cooperation with the detent element 52, entering successive cavities 66 in that element but continuing to be dislodged from those cavities so long as the torque remains above the limit value. The balls, of course, remain lodged in the cavities in which they are received next after the torque falls below the limit value.

Attention is now directed to an upwardly facing shoulder 68 in the bore 12 of the tubular adapter screw, upon which the outer element 45 of the one-way clutch is supported. The downward reaction of the torque limiter springs 53, imposed upon the torque limiter carrier element 51 and transferred to the outer one-way clutch element 45 through the adapter 57, is supported by this shoulder 68. The upward reaction force of the springs 53, imposed upon the detent element 52 through the balls 55, is of course supported by the bolts 75 that secure the detent element to the adapter screw 32. In this manner the axial distance between the opposing surfaces of the upper and lower torque limiter elements 51, 52 is fixed at a small value after the torque limiter 50 is installed in the crushing head.

To facilitate installation of the torque limiter, its carrier element 51 has a threaded concentric bore 70 in which is received a screw 72 that extends through a concentric hole in the detent element 52. When the torque limiter elements are initially assembled with the springs 53 and the balls 55, the elements 51 and 52 are held spaced apart at a substantial distance by the uncompressed springs; but the screw 72 is then used to force those elements axially towards one another while compressing the springs and to hold those elements in the desired axially fixed relationship to one another while the torque limiter is inserted into the tubular adapter screw 32 and the bolts 75 are installed and tightened. The screw 72 is then removed, inasmuch as it is needed only for preassembly and installation of the torque limiter.

When the torque limiter 50 operates to relieve excessive torque, its carrier element 51 and the outer element 45 of the one-way clutch 40 must rotate relative to the crushing head, and therefore those elements must fit in the bore 31 of the tubular adapter screw 32 with some clearance. During such rotation the outer member 45 of the one-way clutch will ride on the circumferential shoulder 68 while being forced down against that shoulder by the springs 53. However, friction on this shoulder has not been found to create any problem with respect to undue wear. For one thing, such relative rotation occurs only infrequently, and then during only a short time—usually less than one rotation of the eccentric shaft. For another thing, lubricating oil forced up through the bore 16 in the eccentric shaft penetrates between the tubular adapter screw 32 and the elements 45 and 51 that can rotate relative to it and minimizes friction during such rotation.

In fact the upward flow of oil through the tubular adapter screw is such that it has been found necessary to install a threaded plug 74 in the central hole in the torque limiter detent element 52 and to interpose an annular gasket 76 between the upper surface of the adapter screw and the flange 64 on that torque limiter element 52, in order to prevent leakage of oil out of the top of the crushing head.

From the foregoing description taken with the accompanying drawings it will be apparent that this invention provides a very simple, compact and efficient bi-directional torque limiter with automatic random reset that releases in response to torque in excess of a high predetermined value, and that the torque limiter of this invention can be advantageously installed in a gyratory crusher with an anti-spin mechanism comprising a one-way clutch, as a direct replacement for the shear pin assembly heretofore employed to protect the one-way clutch.

What is claimed as the invention is:

1. In a gyratory crusher having a stationary frame, an elongated upright eccentric through which a lengthwise bore extends and which is carried by said frame and is driven for rotation in one direction, a substantially conical crushing head carried by said eccentric for rotation relative thereto and for gyratory therewith whereby the crushing head cooperates for crushing with a concave that is substantially stationarily mounted on the frame, and anti-spin mechanism for normally preventing the crushing head from rotating in said one direction but permitting it to rotate in the opposite direction, said anti-spin mechanism comprising a radially outer clutch element that is rotatably seated in a coaxial bore in the crushing head and supported on an upwardly facing shoulder in that bore, a coaxial radially inner clutch element relative to which said outer element is rotatable only in said one direction, and an anti-spin shaft extending through said bore in the eccentric and having at its upper end a nonrotatable connection with said inner element and at its lower end a nonrotatable connection with the frame, a torque limiter that transmits torque of up to a predetermined value from the crushing head to said outer clutch element but otherwise permits the crushing head to rotate relative to the outer clutch element, said torque limiter comprising:

(a) a lower torque limiter element rotatably seated in said bore in the crushing head above said outer element of the one-way clutch and secured to said outer element to be supported thereby and constrained to rotate therewith;

(b) an upper torque limiter element fixed to the crushing head concentrically with said lower torque limiter element and having a bottom surface which opposes and is spaced by a small distance from a top surface on the lower torque limiter element;

(c) a plurality of coiled compression springs, each seated under compression in a well in one of said torque limiter elements that opens to its said surface, said wells being spaced at equal distances from the axis of the torque limiter element and at uniform distances from one another; and (d) a plurality of balls, each having a diameter substantially greater than said small distance and being at all time at least partially received in one of said wells and confined between the spring in that well and the other of said torque limiter elements to be biased by that spring into detent engagement with substantially hemispherical cavities in the other of said torque limiter elements which open to its said surface and are spaced in correspondence with the spacing of said wells.

2. The gyratory crusher of claim 1, further characterized by:

(1) said upper torque limiter element having an axis and having a hole therethrough concentric to the axis thereof; and (2) said lower torque limiter element having a coaxial threaded bore therein which opens to its top surface and into which a bolt that extends through said hole in the upper element can be removably threaded to hold the torque limiter elements preliminarily assembled with one another and with the balls and the springs.

3. A gyratory crusher comprising a stationary frame, a concave mounted on said frame, an upright eccentric mounted on said frame for rotation in one direction, a substantially conical crushing head mounted on said eccentric for rotation relative thereto and for gyratory motion therewith whereby the crushing head cooperates with the concave to effect crushing, and a one-way clutch having a first connection with the frame and having a second connection with the crushing head and whereby the crushing head is normally confined against rotation in said one direction relative to the frame but is permitted to rotate in the opposite direction relative to the frame and the eccentric, said gyratory crusher being characterized by:

one of said connections comprising a torque limiter whereby the crusher head is permitted to rotate in said one direction when torque applied thereto by the eccentric exceeds a predetermined value, to thus prevent damage to said one-way clutch, said torque limiter comprising (a) a pair of torque limiter elements, each having an axis and an axially facing end surface, said elements being confined in coaxial relatively rotatable relationship to one another with their said end surfaces facing one another and spaced apart by a fixed small distance, (1) one of said elements having therein a plurality of wells which open to its said end surface and whcih are at equal distances from its axis and are uniformly spaced from one another, and (2) the other of said elements having a plurality of substantially hemispherical cavities in its said end surface, one for each of said wells, located in corrspondence with the locations of said wells to align with the wells in predetermined positions of relative rotation of said elements;

(b) a plurality of coiled compression springs, one for each of said wells, each said spring being seated in its well; and (c) a plurality of balls, one for each of said wells, each said ball being always at least in part received in its well and normally also being in part received in one of said cavities and maintained therein by the biasing force of the spring in its well, to thus releasably confine the elements against relative rotation.

4. The gyratory crusher of claim 3 wherein said eccentric is substantially tubular with a bore therethrough, said crushing head has a coaxial downwardly opening bore therein in which said one-way clutch is seated, and the other of said connections comprises a shaft which extends through said bore in the eccentric and provides a nonrotating connection between the one-way clutch and the frame, further characterized in that:

said torque limiter is located in said bore in the crushing head, above the one-way clutch and in coaxial relationship thereto, and has one of its said elements connected with the one-way clutch and the other of its said elements rigidly connected with the crushing head.

5. The gyratory crusher of claim 4 wherein said one-way clutch comprises a pair of coaxial clutch elements, one of which is nonrotatably connected with said shaft and the other of which is rotatably seated in said bore in the crushing head and is supported on an upwardly facing shoulder in that bore, further characterized in that:

(1) a lower one of said elements of the torque limiter is rotatable in said bore in the crushing head and is coaxially fixed to said other one of the clutch elements, above the same, to be supported thereby and confined against rotation relative thereto; and (2) the upper one of said elements of the torque limiter has a radially outwardly projecting flange which overlies and is secured to an annular upwardly facing surface on the crushing head that surrounds said bore therein, whereby said upper element is disposed to close the upper end of that bore and is maintained in axially fixed relation to said lower one one of said elements.

* * * * *